US005216965A

United States Patent [19]

Liptak et al.

[11] Patent Number: 5,216,965

[45] Date of Patent: Jun. 8, 1993

[54] RELOCATABLE EXPLOSIVES STORAGE MAGAZINE

[75] Inventors: Richard E. Liptak, Olympia, Wash.; William A. Keenan, Ventura, Calif.

[73] Assignee: The United States of America as represented by the Secretary of the Navy, Washington, D.C.

[21] Appl. No.: 901,619

[22] Filed: Jun. 15, 1992

[51] Int. Cl.[5] ..... E05G 1/06

[52] U.S. Cl. ..... 109/27; 109/45; 109/49.5; 109/55

[58] Field of Search ..... 109/1 S, 1 V, 49.5, 109/24, 26–28, 36, 45–7, 53, 58, 58.5, 65–68, 78; 206/3, 317

[56] References Cited

U.S. PATENT DOCUMENTS

| | | | |
|---|---|---|---|
| 386,696 | 7/1888 | Elwell | 206/3 X |
| 808,854 | 1/1906 | Mayer | 206/3 |
| 1,026,207 | 5/1912 | Johnson | 109/27 |
| 1,965,296 | 7/1934 | Miller | 109/55 |
| 2,315,799 | 4/1943 | LaGuardia et al. | 109/1 |
| 2,348,416 | 5/1944 | Posey | 109/49.5 |
| 2,795,323 | 6/1957 | Amundsen | 206/3 |
| 3,731,585 | 5/1973 | Demberg et al. | 206/3 |
| 3,756,387 | 9/1973 | Chaney | 206/3 |
| 3,757,933 | 9/1973 | Banta | 206/3 |
| 3,924,038 | 12/1975 | McArdle et al. | 428/29 |
| 4,100,860 | 7/1978 | Gablin et al. | 109/83 |
| 4,248,342 | 2/1981 | King et al. | 206/3 |
| 4,325,309 | 4/1982 | King et al. | 109/49.5 |
| 4,326,468 | 4/1982 | King et al. | 109/49.5 |
| 4,347,796 | 9/1982 | King et al. | 109/49.5 |
| 4,389,947 | 6/1983 | King et al. | 109/15 |
| 4,432,285 | 2/1984 | Boyars et al. | 109/49.5 |
| 4,666,034 | 5/1987 | Johnson et al. | 206/3 |
| 4,666,035 | 5/1987 | Johnson | 206/3 |

*Primary Examiner*—Lloyd A. Gall

*Attorney, Agent, or Firm*—Ron Billi; Melvin J. Sliwka

[57] ABSTRACT

A relocatable storage magazine is provided for containing the shockwave, conflagration and flying debris of an accidental explosion of stored explosives, ordnance or the like and includes a container; a debris trap attached to the container for receiving the pressure wave and for containing flying debris; an access hole communicating with the container and with the debris trap for venting the pressure wave of an explosion from the container into the debris trap and for providing access to the container; a lid cover and storage tray for storing and retrieving explosives; vent holes in the debris trap for venting the pressure wave to the atmosphere; a sliding door for providing access to the storage magazine; ears for lifting and relocating the storage magazine; hooks for retaining the lid cover and storage tray in an accessible position.

11 Claims, 2 Drawing Sheets

RELOCATABLE EXPLOSIVES STORAGE MAGAZINE

BACKGROUND OF THE INVENTION

The present invention relates generally to containers for storing explosives, ordnance and the like. More specifically, but without limitation, the present invention relates to a relocatable explosives storage magazine for storing and retrieving both cased and uncased explosives, said container configured to partially contain and attenuate the shock wave, conflagration and flying debris produced by an accidental explosion within the container.

The storage of explosives, ordnance and the like presents the ever present danger of accidental discharge with the resultant damage caused by the shock wave, conflagration and flying debris. Attempts have been made to configure devices that can minimize or eliminate an accidental explosive event. It is common practice to build storage structures with thick concrete walls, roofs and floors of, for example, 3 feet thick or more, to contain an accidental blast. Use of various materials, shapes and sizes of containers are commonplace. In some cases, an explosive container is surrounded with a massive barricade such as an earth berm, sandbag walls or simply by burying in the ground. However, the container is then difficult to access, not easily relocatable and expensive to deploy. Alternatively, structures have been designed to yield and/or break away under blast pressures thereby reducing the impact and effect of the initial blast. Other devices have been designed to reduce, dissipate and/or absorb the initial blast pressure, conflagration and flying debris by the use of a shield and/or shield composites. Such devices are shown in U.S. Pat. Nos. 4,248,342; 4,325,309; 4,326,468; 4,347,796 and U.S. Pat. No. 4,389,947 to King et. al. and in U.S. Pat. No. 3,924,038 to McArdle et. al. Other devices have been configured to attenuate a blast by providing a breakaway two part structure in the form of a bucket, the first part providing attenuation of the explosive shock wave and the second part yielding to provide minimum attenuation characteristics in one direction. Such a device is shown in U.S. Pat. No. 4,432,285. However, these devices do not meet both physical security requirements for the storage of explosives and blast attenuation requirements as required by (NAVFAC P-397 design criteria and NAVSEA OP-5 explosives safety regulations). It is therefore desirable and required to provide an apparatus in which explosives and the like may be stored and easily retrieved that will attenuate an accidental blast and confine the blast to an area sufficient to meet minimum explosive safety requirements, that will satisfy security requirements, and that is inexpensive and easy to fabricate.

SUMMARY OF THE INVENTION

Accordingly, the relocatable storage magazine of the present invention includes a container for storing explosives and for partially containing and attenuating an explosive blast; a debris trap attached to the top of said container for catching debris and fragments from the explosive blast; means for venting the pressure wave from said debris trap to the atmosphere; an access hole communicating with said debris trap and with said container; a movable lid cover located in said access hole; a storage tray suspended in said container and attached to said lid cover by cables said lid cover and said storage tray movable from a first storage position to a second elevated position; means for retaining said lid cover and said storage tray in the said elevated position; and a slidable access door located in said debris trap.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
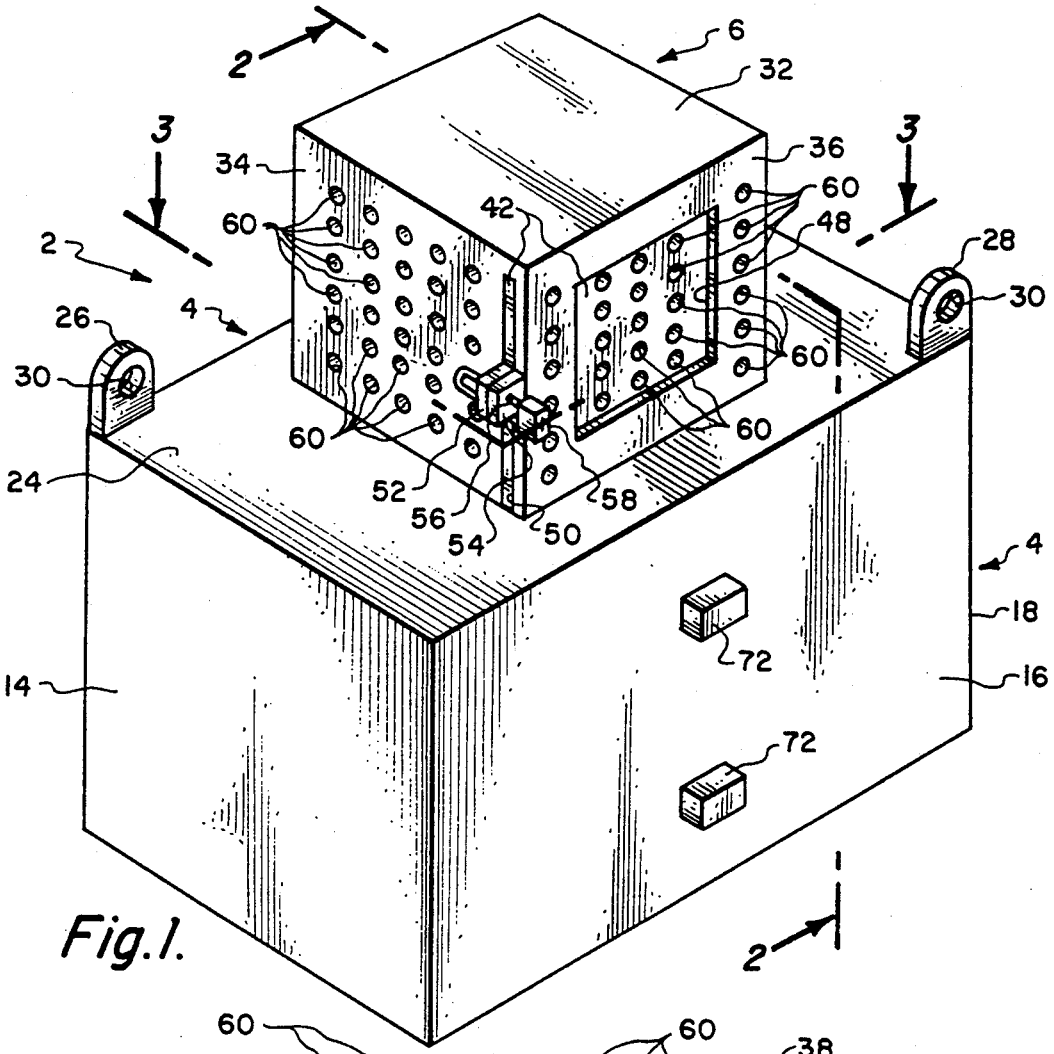
FIG. 1 is a perspective view of the present invention showing the container, debris trap, and sliding door.
Figure 3:
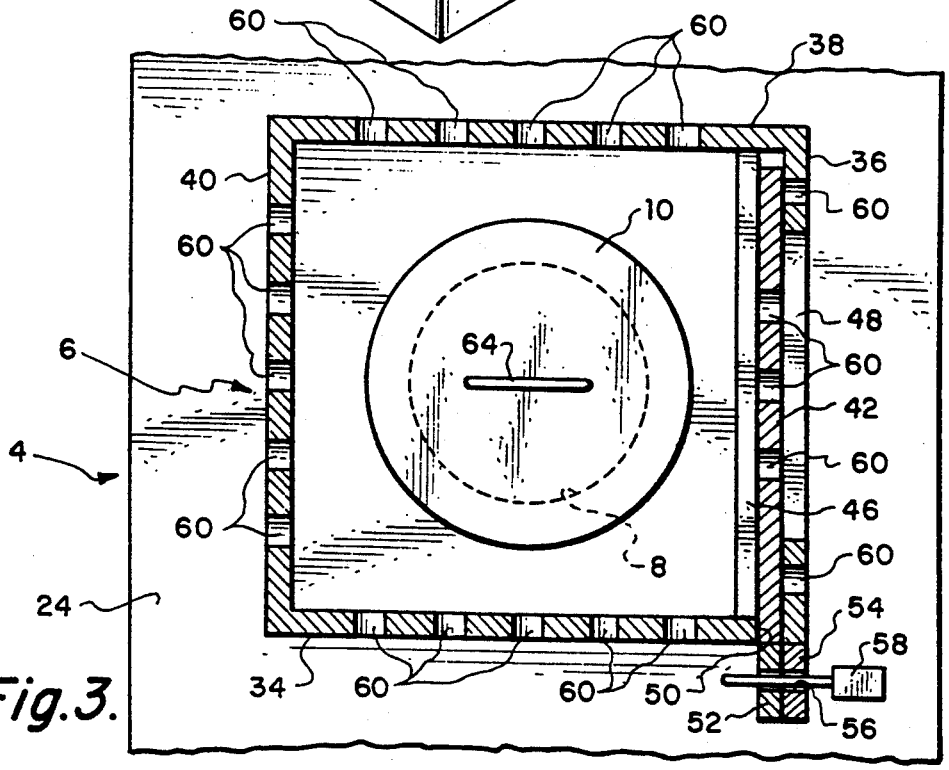
FIG. 3 is a cross sectional view of the present invention taken through lines 3—3 of FIG. 1.
Figure 2:
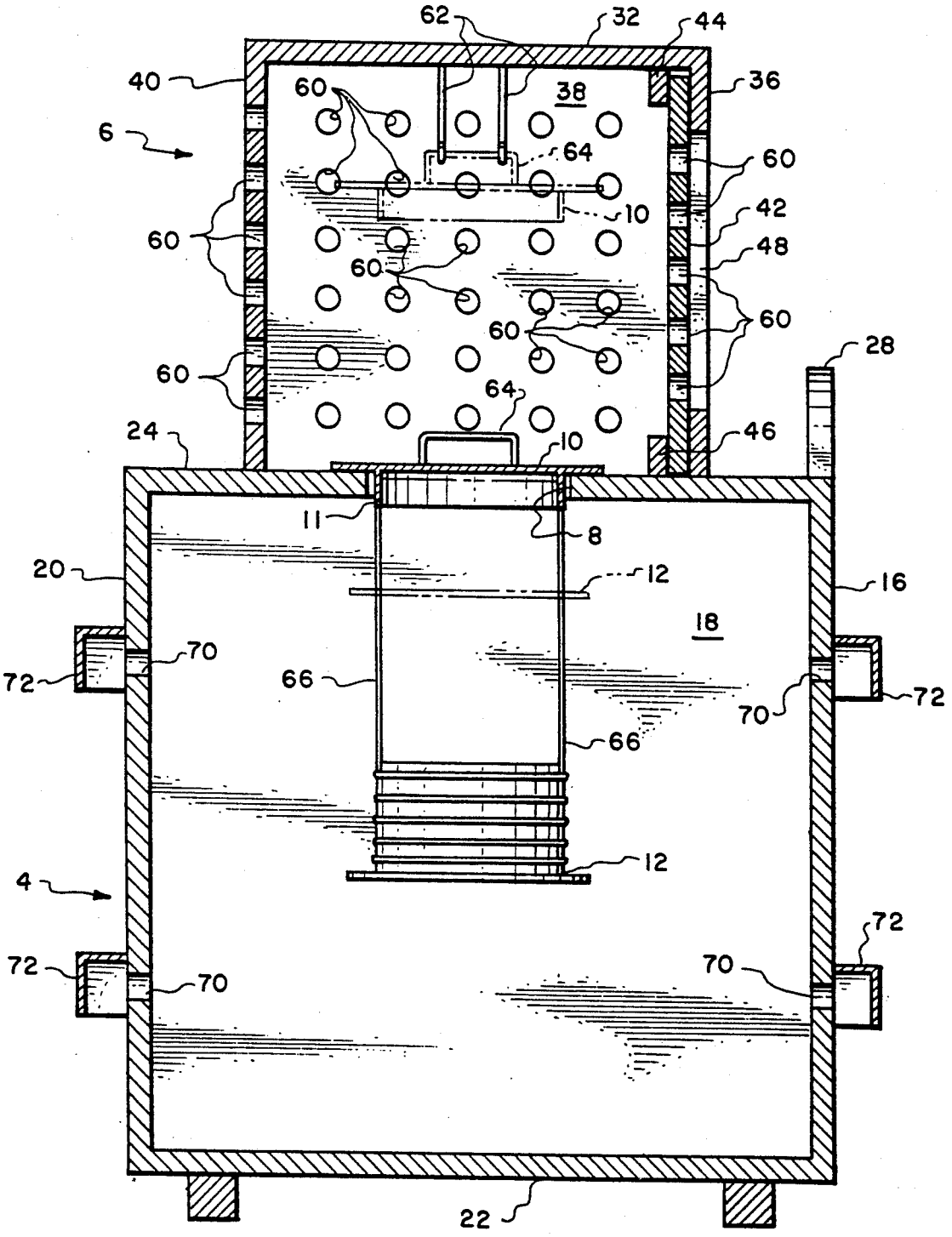
FIG. 2 is a cross sectional view of the present invention taken through lines 2—2 of FIG. 1, showing the lid cover, storage tray, and cables in the stored position and in the elevated position (in phantom) as well as showing the access hole.

The present invention is illustrated by way of example in FIGS. 1 through 3. As shown in FIGS. 1 and 2, storage magazine 2 includes container 4, debris trap 6, access hole 8 and lid cover 10. In the preferred embodiment, container 4 includes sides 14, 6, 18, and 20; bottom 22 and top 24 attached, for example, by welding of the full penetration type to develop maximum strength. Ears 26 and 28 are attached to top 24 and include bores 30. Storage magazine 2 may be lifted and moved about for example, with a crane, by attaching to ears 26 and 28. Access hole 8 is located in top 24 and is circular in shape. In the preferred embodiment, container 4 is approximately 3 feet 2 inches square with access hole 8 approximately 10 inches in diameter. Thus, the area of access hole 8 is approximately 55% of the area of side 24.

Debris trap 6 includes top 32 sides 34, 36, 38, and 40 attached, for example, by full penetration welds. Sliding door 42 is located between side 36 and brace 44 on the top and between side 36 and brace 46 on the bottom. FIG. 1 shows door 42 in the closed position closing off opening 48 in side 36. Door 42 is moved to the open position by sliding door 42 through opening 50 in side 34. Ear 52 is attached to door 42 and ea 54 is attached to side 34, both ears having bores 56 located therein. When door 42 is closed, ears 52 and 54 are adjacent and parallel and bores 56 line up so that padlock 58 may simultaneously engage both bores. Vent holes 60 are located in sides 34, 36, 38, and 40 of debris trap 6 and in door 42 in the area of opening 48 (see FIGS. 1 and 2). It is preferred that the total area of the vent holes is greater than the area of access hole 8. Hooks 62 are attached to top 32 and handle 64 is attached to the upper side of lid cover 10 as shown in FIG. 2. Lid cover 10 is circular in shape and includes lip 11 which extends perpendicularly from one side of cover 12. Lip 11 is circular in shape and is slightly smaller in diameter than access hole 8. It can thus be seen in FIG. 2, that cover 10 is placed in such a way that lip 11 is located inside access hole 8 and cover 10 sits on top of and closes off access hole 8. Cables 66 communicate with storage tray 12 on one end and with lip 11 on the other end. It can thus be seen that storage tray 12 may be located in a first position, central to container 4, by placing lid cover in in access hole 8 or in a second position (see FIG. 2 in phantom), adjacent access hole 8, by placing handle 64 on hooks 62. In the second position, storage tray 12 may be easily accessed through opening 48 when door 42 is in the open position. Explosives and the like are placed into and removed from storage tray 12 while storage tray 12 is in the second position. Storage tray 12 is then lowered to the first position for storage. Vent holes 70 and vent covers 72 allow the inside of container 4 to breath.

In the event of an accidental explosion, gas pressure is vented through the access hole 8 and into the debris trap 6. Debris trap 6 stops fragments and debris and also vents gas pressure to the atmosphere. The present invention is designed as a one creditable event, that is to say that if an accidental explosion occurs, the storage magazine would most probably be destroyed and could not be reused. However, the area over which debris would be scattered is reduced by 77%.

Obviously many modifications and variations of the present invention are possible in light of the above teachings. It is therefore to be understood that within the scope of the appended claims, the invention may be practiced otherwise than as specifically described.

What is claimed is:

1. A relocatable storage magazine apparatus for storing and retrieving explosives and ordnance and for partially containing and attenuating the blast, conflagration and flying debris from an accidental explosion comprising:

(a) a container having an access hole;

(b) a debris trap attached to the container, the debris trap communicating with said container via the access hole, said debris trap having vent holes for venting the pressure of an explosion from said debris trap to the atmosphere;

(c) means for covering said access hole;

(d) means for suspending explosives and ordnance from the covering means;

(e) means for entering the storage magazine to store and retrieve explosives and ordnance;

(f) means for retaining said covering means in a position above the access hole wherein said explosives and ordnance are accessible from the entering means.

2. The apparatus defined in claim 1, wherein said container is a cube.

3. The apparatus defined in claim 2, wherein said debris trap includes four sides and a top.

4. The apparatus defined in claim 3, wherein said vent holes are located in the sides of said debris trap.

5. The apparatus defined in claim 4, wherein said container includes ears for lifting and relocating said storage magazine.

6. The apparatus defined in claim 5, wherein said entering means is a sliding door.

7. The apparatus defined in claim 6, wherein said sliding door includes vent holes.

8. The apparatus defined in claim 7, wherein said covering means is a circular cover having a circular lip located inwardly from the diameter of the cover and extending from the downward side of said cover, the circular lip communicating with said access hole when said cover is covering said access hole, said cover having a diameter greater than the diameter of said access hole.

9. The apparatus defined in claim 8, wherein said suspending means includes a storage tray and at least two cables, each cable including a first and second end, the first end of each cable attached to said covering means and the second end of each cable attached to the storage tray, said cables evenly spaced around both said storage tray and said covering means.

10. The apparatus defined in claim 9, wherein said each cable is attached to said circular lip.

11. The apparatus defined in claim 10, wherein said retaining means includes a handle and at least two hooks, the handle attached to the upward side of said covering means and the hooks attached to the top of said debris trap, said handle and hooks communicating when said storage tray is retained in a position adjacent said access hole

* * * * *